US010711783B2

(12) United States Patent
Monet

(10) Patent No.: US 10,711,783 B2
(45) Date of Patent: Jul. 14, 2020

(54) SCROLL COMPRESSOR WITH COATED SLIDING SURFACE

(71) Applicant: LIEBHERR-AEROSPACE TOULOUSE SAS, Toulouse (FR)

(72) Inventor: Eric Monet, Villematier (FR)

(73) Assignee: LIEBHERR-AEROSPACE TOULOUSE SAS, Toulouse (FR)

( * ) Notice: Subject to any disclaimer, the term of this patent is extended or adjusted under 35 U.S.C. 154(b) by 542 days.

(21) Appl. No.: 15/512,232

(22) PCT Filed: Jul. 1, 2015

(86) PCT No.: PCT/FR2015/051821

§ 371 (c)(1),
(2) Date: Jun. 28, 2017

(87) PCT Pub. No.: WO2016/042218

PCT Pub. Date: Mar. 24, 2016

(65) Prior Publication Data

US 2017/0306956 A1 Oct. 26, 2017

(30) Foreign Application Priority Data

Sep. 17, 2014 (FR) ..... 14 58761

(51) Int. Cl.
*F04C 18/02* (2006.01)

(52) U.S. Cl.
CPC ..... *F04C 18/0269* (2013.01); *F04C 18/0215* (2013.01); *F04C 18/0253* (2013.01);
(Continued)

(58) Field of Classification Search
CPC ..... F04C 18/0269; F04C 18/0253; F04C 18/0215; F04C 18/0284
(Continued)

(56) References Cited

U.S. PATENT DOCUMENTS 6,079,962 A 6/2000 Seibel et al.
6,146,117 A * 11/2000 Miura ..... F01C 17/066 418/55.3

(Continued)

FOREIGN PATENT DOCUMENTS

EP 0833057 A2 4/1998
EP 2312163 A1 4/2011

(Continued)

OTHER PUBLICATIONS

Aluminum-Silicon Casting Alloys, ASM Internationl, 2004.*

(Continued)

*Primary Examiner* — Deming Wan
(74) *Attorney, Agent, or Firm* — Volpe and Koenig, P.C.

(57) ABSTRACT

A compression device includes at least: two interleaved scrolls each of which is made of an aluminum alloy, one of the scrolls, being a fixed scroll (3), and is fixed and the other scroll, which is an orbiting scroll and moves eccentrically without rotating. Also included are anti-rotation means made of an aluminum alloy and configured to allow anti-rotation of the orbiting scroll. The compression device also includes one flat thrust bearing configured to axially contain the orbiting scroll and is made of aluminum alloys or grades of cast iron. The compression device also includes coatings for promoting friction between the fixed scroll, the orbiting scroll, the anti-rotation means and the flat thrust bearing.

13 Claims, 4 Drawing Sheets

(52) U.S. Cl.
CPC ..... *F04C 18/0284* (2013.01); *F04C 2230/41* (2013.01); *F04C 2230/91* (2013.01); *F04C 2230/92* (2013.01); *F04C 2240/50* (2013.01); *F04C 2240/80* (2013.01); *F05C 2201/021* (2013.01); *F05C 2201/028* (2013.01); *F05C 2201/0412* (2013.01); *F05C 2201/0439* (2013.01); *F05C 2225/04* (2013.01); *F05C 2251/04* (2013.01); *F05C 2251/10* (2013.01)

(58) Field of Classification Search
USPC ..... 418/55.1–55.5, 179
See application file for complete search history.

(56) References Cited

U.S. PATENT DOCUMENTS 6,387,543 B1 * 5/2002 Eichmann ..... C23C 14/16 416/204 R
2008/0102296 A1 * 5/2008 Ghasripoor ..... C23C 14/0641 428/469
2009/0277212 A1 * 11/2009 Kaneko ..... C10M 133/16 62/468
2009/0280018 A1 * 11/2009 Ichiyanagi ..... F04C 18/0215 418/55.1
2010/0196183 A1 8/2010 Ni et al.
2011/0081264 A1 * 4/2011 Ishizono ..... F04C 18/0207 417/410.5
2013/0017100 A1 * 1/2013 Ota ..... F01C 21/10 417/321
2013/0121866 A1 5/2013 Jang et al.

FOREIGN PATENT DOCUMENTS

WO 2009055009 A2 4/2009
WO 2010116747 A1 10/2010

OTHER PUBLICATIONS

DLC Diamond-Like Carbon Coatings, www,acreetech.com, 2004.*
L. Rama Krishna et al: "A comparative study of tribological behavior of microarc oxidation and hard-anodized coatings", WEAR, vol. 261, No. 10, Nov. 1, 2006 (Nov. 1, 2006). pp. 1095-1101. XP055217806, ISSN: 0043-1648, DOI: 10.1016/j.wear.2006.02.002 abstract.

* cited by examiner

SCROLL COMPRESSOR WITH COATED SLIDING SURFACE

FIELD OF THE INVENTION

This invention relates to a compression device and to a scroll compressor comprising such a device.

The invention has applications in the cold and air conditioning industry, in particular, for refrigeration system applications such as air conditioning in vehicles.

BACKGROUND

A scroll compressor makes it possible to compress a gas. A compression stage of a scroll compressor comprises two interleaved scrolls in such a way as to suck and compress a gas. One of the scrolls is fixed while the other moves eccentrically without rotating.

A compression cycle comprises a step of sucking gas, then a step of compressing this gas and finally a step of discharging compressed gas. The eccentric movement of one of the scrolls in relation to the other allows for the suction of a gas from the external portion of the scrolls. The sucked gas forms a pocket of gas driven towards the center of the scrolls. As the pocket moves towards the center of the scrolls, it becomes smaller and smaller. As such, the pressure of the gas increases until the desired discharge pressure is reached. Once this pressure is reached, the gas is discharged, by unloading the pocket, via a discharge orifice at the center of the scrolls.

In industry, scroll compressors have different characteristics according to their application.

In the automotive cold industry, a scroll compressor comprises:

two scrolls made of aluminum, of which one of them does not have a coating and incorporates a scroll prop and the other incorporates a hard surface treatment, top scroll seals that make it possible to guarantee the axial seal between the scrolls, and a thrust ball bearing that provides both the taking of the axial forces that tend to separate the scrolls from one another and the anti-rotation of the orbiting scroll.

The disadvantage of the thrust ball bearing is based on its principle itself, which leads to having the axial forces transit only via contact points between the tracks and the balls, as such limiting the level of effort that is transmissible and the potential service life in relation to technologies that include a flat thrust bearing or a counter-pressure thrust bearing.

In addition, integrating a scroll prop can lead to a deterioration of the scroll whereon it is mounted due to a relative movement during operation between said prop and its scroll induced by the mounting clearances. This movement will be amplified as the deterioration of the bottom of the scroll occurs via matting and will generate a cutting of the scroll. This phenomenon therefore induces a lower service life with respect to technologies that do not include a scroll prop.

In the stationary cold industry, a scroll compressor comprises:

two scrolls made of cast iron, top scroll seals for the axial seal between scrolls, an Oldham seal made of aluminum carrying out the anti-rotation of the orbiting scroll, and a flat thrust bearing made of cast iron that ensures the taking of the axial forces.

This type of compressor with a flat thrust bearing therefore makes it possible to overcome the weakness of the thrust ball bearing by replacing it with the flat thrust bearing.

However, the use of the flat thrust bearing imposes a lubrication management that makes it possible to guarantee a film of oil between the orbiting scroll and the thrust bearing.

In another known solution of the stationary cold industry, a scroll compressor comprises:

two scrolls made of cast iron, an Oldham seal made of aluminum that carries out the anti-rotation of the orbiting scroll, and a counter-pressure thrust bearing made of cast iron that ensures both the taking of the axial forced and the axial seal between scrolls by using said counter-pressure in order to ensure the maintaining in contact thereof.

The operation of the counter-pressure thrust bearing is made possible through the use of the scroll made of cast iron. Indeed, cast iron is able to resist a strong level of friction and axial forces, contrary to aluminum.

This type of compressor with counter-pressure thrust bearing also makes it possible to overcome the weakness of the thrust ball bearing by replacing it with the counter-pressure thrust bearing. In addition, the counter-pressure effort makes it possible to overcome scroll seals and allows for very simplified lubrication management in this zone. However, the level of force of the counter pressure induces losses that are higher than those of the compressor with a flat thrust bearing.

These two compressors in the stationary cold industry are heavier and more cumbersome than that of the technology of the automotive cold industry due to the use of scrolls made of cast iron.

Document EP 2 312 163 discloses a scroll compressor comprising, contained in a sealed case, a section of an electric motor, a section of a compression mechanism connected to the section of the electric motor, an oil sump for the lubrication oil and providing the compression of a refrigerant fluid by the compression mechanism section. The refrigerant fluid used is a halogenated hydrocarbon or a hydrocarbon that each has a carbon-carbon double bond in their composition or a mixture containing one from the halogenated hydrocarbon and the hydrocarbon. A sliding surface of at least one of the two parties forming a sliding section wherein the two parts slide over one another in the sealed case is configured in such a way that an iron-base or aluminum-base metal is not exposed directly.

Document U.S. Pat. No. 6,079,962 discloses a scroll compressor wherein a component made of an aluminum alloy that has a surface intended to be in contact with another component of the scroll compressor comprises between 2 and 18% of graphite particles in said alloy in a region neighboring this surface.

These documents show the use of aluminum alloy in a scroll compressor but the solutions proposed here do not provide for having a scroll made of aluminum and a thrust bearing also made of aluminum. The coatings revealed in these documents are thin coatings of the OAC, OAD, phosphating, hard chromium, DLC, WCC, TiN, TiCN, etc. type. Such coatings are not suitable for operating with low lubrication.

This invention aims to suppress, or at least attenuate, all or a portion of the disadvantages of the aforementioned prior art.

In particular, this invention aims to propose a compression device that has high reliability while still remaining light.

As such this invention aims to allow for the use of aluminum in a compression device despite the high levels of pressure used in fields such as aeronautics.

In addition, this invention in particular has for purpose to overcome a complex lubrication management system without altering the reliability of the thrust bearing. A purpose of the invention is as such in particular to propose a solution that makes it possible to use light materials in a compression device operating with an elasto-hydrodynamic lubrication regime using a low quantity of lubricant.

Furthermore, this invention in particular aims to propose a compression device that has a long service life.

The compression device according to the invention will also more preferably be easy to adjust and/or not cumbersome and/or with a moderate cost price.

SUMMARY

To this effect, this invention proposes a compression device that comprises at least:

two interleaved scrolls and each of which is made of an alloy with a density less than 5, wherein one of the scrolls, referred to as the fixed scroll, is fixed and the other scroll, referred to as the orbiting scroll, moves eccentrically without rotating, anti-rotation means made of an aluminum alloy and suitable for allowing anti-rotation of said orbiting scroll, and a flat thrust bearing (7) suitable for axially retaining the orbiting scroll (5).

According to the invention, the surface of the scroll intended to come into contact with the flat thrust bearing is covered with a thick coating, of a thickness between 40 and 200 μm, with a hardness greater than 1100 HV and comprised mostly of an oxide coming from the light alloy.

Tests have shown that such a compression device allows for the use of scrolls made of a light alloy combined with the use of an anti-rotation means made of a light alloy as well as with the use of a flat thrust bearing thanks to the type of coating proposed, with this combination never having been used in prior art.

Using light alloys advantageously makes it possible to have a compression device of which the mass is limited.

The use of a flat thrust bearing allows, advantageously, the compression device to have substantial reliability. In addition, the use of a flat thrust bearing also makes it possible to simplify the design and the mounting of the compression device.

The coatings proposed make it possible to have substantial levels of hardness between the surfaces in contact with the various parts and as such to retain a differential friction torque between said surfaces in contact in order to prevent a premature wear and tear of the surfaces.

Furthermore, the various coatings allow for the advantageous use of parts made of an aluminum alloy without the latter being deteriorated even at high pressure levels such as encountered in aeronautical applications. Indeed, the coating provided on the scroll made of a light alloy makes it possible, thanks to its hardness but also its thickness, to prevent deformations of the alloy to the extent that operation in elasto-hydrodynamic lubrication regime can be considered, which limits the quantity of lubricant required.

The use of various coatings in combination with the use of a flat thrust bearing which can be formed of a light alloy or also of a grade of cast iron advantageously makes it possible to overcome lubrication management by decreasing the sensitivity of the interfaces until resisting an operation without lubrication while still guaranteeing a good service life of the compression device.

In such a compression device, the scrolls are for example made of a material selected from a set of materials including aluminum, magnesium and titanium alloys.

In order to limit the mass of the compression device, the flat thrust bearing is preferably made of a material selected from a set of materials including aluminum, magnesium and titanium alloys, and then the surface of the flat thrust bearing intended to come into contact with the scroll is advantageously covered with a thick coating, of a thickness between 40 and 200 μm, of a hardness greater than 1100 HV and comprised mostly of an oxide coming from the light alloy.

In such a compression device, the thick coating carried out on the scroll and/or on the flat thrust bearing preferably has a thickness between 60 and 80 μm. This coating is preferably an oxidation layer of the alloy obtained by a micro-arc oxidation method.

A preferred embodiment of this compression device provides that the flat thrust bearing and the scroll facing this flat thrust bearing are made from an aluminum alloy that can resist temperatures greater than 150° C.

Such a compression device can be such that it further comprises at least one scroll prop glued to one of the two scrolls by means of a structural adhesive that resists temperatures of up to 180° C. The scroll prop advantageously makes it possible to promote friction between the fixed scroll and the orbiting scroll in order to as such limit the wear and tear thereof. The gluing of the scroll prop to one of the two scrolls advantageously makes it possible to improve the reliability of the compression device.

Advantageously, the fixed scroll can have a hard anodization treatment impregnated with Polytetrafluorethylene (PTFE) at least on one surface facing the orbiting scroll.

Also in an embodiment, the anti-rotation means can have a hard anodization treatment impregnated with PTFE at least on one surface facing the fixed scroll and/or on at least one surface facing the orbiting scroll.

The hard anodization treatment impregnated with PTFE advantageously makes it possible to promote friction and as such limit the wear and tear of the various parts in contact with one another.

According to embodiments of the invention, taken separately or in combination, the compression device further comprises at least:

one first support formed from a grade of cast iron and suitable for interfacing with the fixed scroll by providing a connection between said fixed scroll and the anti-rotation means, and one second support formed from a grade of cast iron and suitable for interfacing with the orbiting scroll by providing a connection on the one hand between said orbiting scroll and the anti-rotation means, and on the other hand between said orbiting scroll and the flat thrust bearing.

The first support and/or the second support advantageously make it possible to optimize the anti-rotation connection between the fixed scroll and the orbiting scroll and the connection between the orbiting scroll and the flat thrust bearing by improving their robustness while still retaining a significant weight gain.

Finally, this invention relates to a scroll compressor comprising a compression device such as described hereinabove.

BRIEF DESCRIPTION OF THE DRAWINGS

Details and advantages of this invention shall appear better when reading the following description, given in reference to the annexed diagrammatical drawings wherein.

DETAILED DESCRIPTION OF THE PREFERRED EMBODIMENTS

Figure 1:
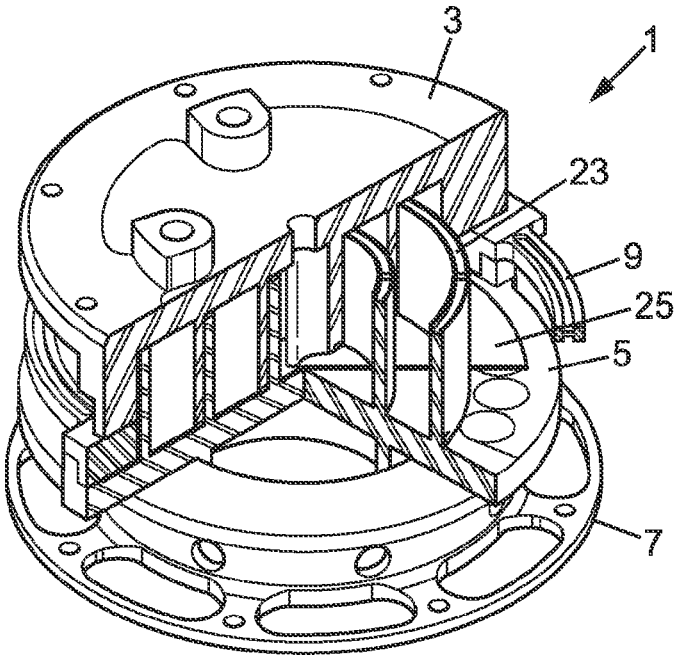
FIG. 1 is a perspective partial cross-section view of a compression device according to a first embodiment.
Figure 2:
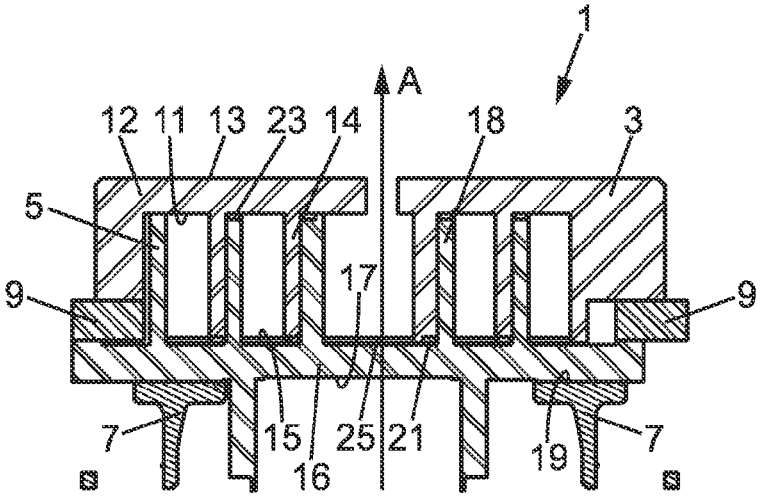
FIG. 2 is a longitudinal cross-section view of the compression device of FIG. 1.
Figure 3:
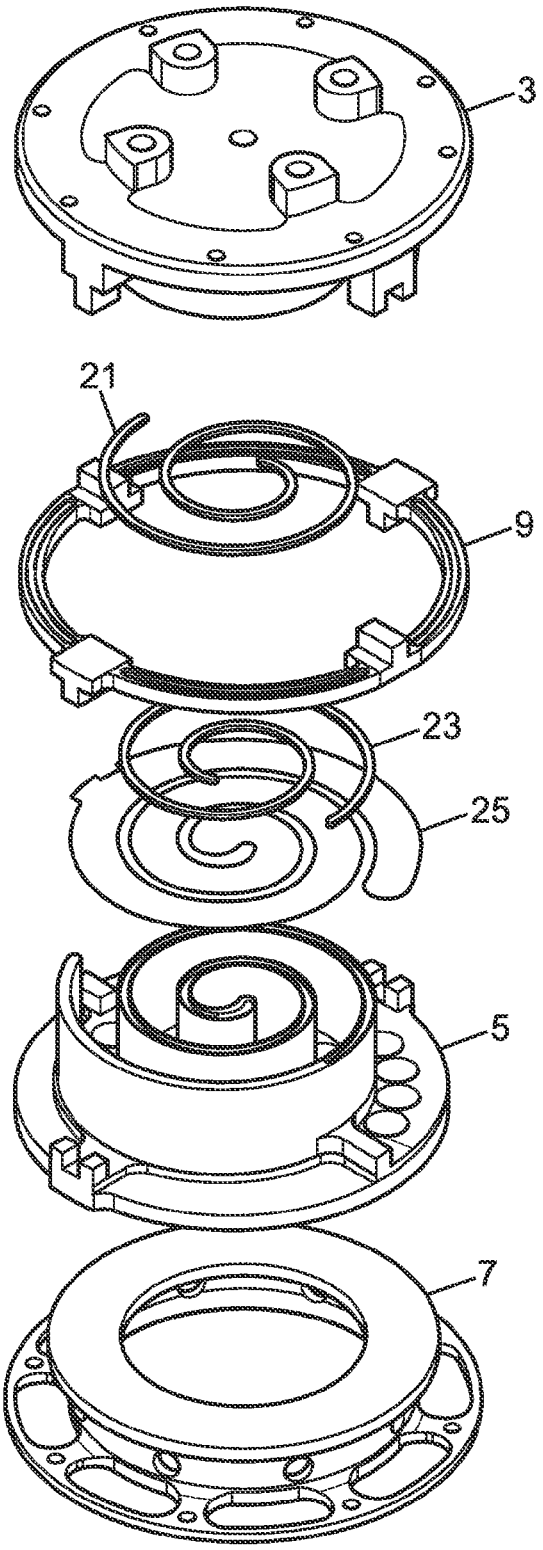
FIG. 3 is an exploded view in perspective of the compression device of FIG. 1.

FIG. 1 and FIG. 2 show the general structure of an embodiment of a compression device 1 according to this invention. Likewise, FIG. 3 shows in an exploded view the general structure of said compression device 1.

The compression device 1 comprises a fixed scroll 3 interleaved with an orbiting scroll 5. The means of driving the orbiting scroll 5 are not shown in the figures. However their operation is known to those skilled in the art and therefore is not described here. Furthermore, the compression device 1 comprises anti-rotation means and a flat thrust bearing 7.

The fixed scroll 3 and the orbiting scroll 5 are here made of a light alloy, with a density less than 5 (i.e. a density less than 5000 $kgm^{-3}$). It is assumed in the rest of the description that this is an aluminum alloy but this could also be for example a magnesium or titanium alloy.

In this embodiment, the fixed scroll 3 is comprised of a plate 12 in the shape of a disc that has an inner surface 11 and an outer surface 13. A wall 14 in the shape of a scroll having a center and an outer end extends protruding perpendicularly to the plate 12, from the inner surface 11. Similarly, the orbiting scroll 5 is comprised of a plate 16 in the shape of a disc having an inner surface 15 and an outer surface 17. A wall 18 in the shape of a scroll having a center and an outer end extends protruding perpendicularly to the plate 16, from the inner surface 15.

The fixed scroll 3 and the orbiting scroll 5 can be positioned facing in such a way that their respective walls are interleaved one in the other and in that the inner surface 11 is facing the inner surface 15.

The orbiting scroll 5 is in movement, in relation to the fixed scroll 3. It moves eccentrically without rotating, i.e. it has a circular translation movement in a plane corresponding to that of the plates 12, 16.

During the operation of the compressor, the fixed scroll 3 and the orbiting scroll 5 have several parts in contact in such a way as to imprison pockets of gas sucked from the outer ends of the scrolls. As the eccentric movement of the orbiting scroll 5 takes place, these pockets of gas transit towards the center of the scrolls while becoming increasingly smaller in order to as such compress the gas present in these pockets. This movement of pockets is the result of the fact that the parts of the scrolls which are in contact change with the eccentric movement of the orbiting scroll 5.

The flat thrust bearing 7 has, in this embodiment, an annular shape that has an upper planar surface 19 in contact with the orbiting scroll 5 and more precisely the outer surface 17. In an embodiment, the flat thrust bearing 7 is formed of a light alloy, for example an aluminum alloy. It can also be a magnesium or titanium alloy or another light metal alloy (density less than 5). In another embodiment—not preferred as it is penalizing in terms of mass but can possibly be considered—, the flat thrust bearing 7 is formed of a grade of cast iron.

Axial forces due to the pressure tend to separate the fixed scroll 3 from the orbiting scroll 5. The flat thrust bearing 7 has for function to maintain, along a longitudinal axis A, the longitudinal position of the orbiting scroll 5 in order to prevent the scrolls 3, 5 from separating. For this, the axial forces are taken up by the flat thrust bearing 7 thanks to a contact between the outer surface 17 of the orbiting scroll 5 and an upper surface 19 of the flat thrust bearing 7. A film of oil is present between these two surfaces, in order to limit wear and tear, without any specific maintenance being required for the latter. The lubrication regime in this example of application is an elasto-hydrodynamic regime.

The orbiting scroll 5 is associated with anti-rotation means that provide a circular translation movement without the scroll rotating about the longitudinal axis A. These means comprise for example a fixed finger sliding in a rib made on the orbiting scroll 5. In a preferred embodiment, the anti-rotation of the orbiting scroll 5 is provided by an Oldham seal 9. The Oldham seal 9 is then, as shown in the figures, positioned between the fixed scroll 3 and the orbiting scroll 5. It has, in this embodiment, an annular shape comprising tabs protruding towards the fixed scroll 3 and towards the orbiting scroll 5. The fixed scroll 3 comprises grooves directed towards the Oldham seal 9. Each groove is suitable for receiving the corresponding tab in such a way as to allow for a sliding between the Oldham seal 9 and the fixed scroll 3. Similarly, the orbiting scroll 5 comprises grooves directed towards the Oldham seal 9. Each groove is suitable for receiving the corresponding tab in such a way as to allow for a sliding between the Oldham seal 9 and the orbiting scroll 5 while still preventing the latter from having a rotation movement.

The Oldham seal 9 is more preferably formed from the same material as the scrolls, here from an aluminum alloy.

In addition, the components of the compression device 1 described hereinabove comprise a coating.

As such, the Oldham seal 9 preferably has a hard anodization treatment impregnated with Polytetrafluorethylene (PTFE) on the surfaces intended to be in contact with one or the other of the scrolls.

The fixed scroll 3 also preferentially has a hard anodization treatment impregnated with PTFE on its surfaces intended to be in contact with the orbiting scroll 5, i.e. on the inner surface 11 as well as on the faces of the walls 14, 18 protruding in the shape of a scroll from said fixed scroll 3. The fixed scroll 3 can have, on the surfaces in contact with the Oldham seal 9, a treatment masking or a ceramic coating or another surface treatment by anodic oxidation.

A treatment by hard anodization makes it possible to cover the treated part with a rather thick coat of alumina, of which the resistance to wear and tear as well as the resistance to corrosion are very good.

The smooth nature of the PTFE produces a surface that has superior capacities for the release of dust which therefore makes it possible to optimize the coefficient of friction while still supplying a resistance to chemical products.

The orbiting scroll 5 preferentially has a ceramic coating over the surface in contact with the flat thrust bearing 7. Also, in the embodiment wherein the flat thrust bearing 7 is formed of a light alloy, the latter preferentially has a ceramic coating on the surface in contact with the orbiting scroll 5.

The ceramic coating can be obtained by a method of micro-arc oxidation (MAO) which is an electrochemical method that makes it possible to obtain coating comparable to ceramics. This method is also known as the plasma electrolytic oxidation method. In order to carry out the coating, the following method steps are preferably implemented:

immersion of the metal part to be coated in an electrolytic bath comprised of an aqueous solution of alkaline metal hydroxide, such as potassium or sodium, and of a salt of an oxyacid of an alkaline metal, with the metal part forming one of the electrodes, application to the electrodes of a signal voltage of a generally triangular shape, i.e. having at least one front slope and one rear slope, with a variable form factor during the method, generating a current that is controlled in its intensity, its shape and its relationship between the positive intensity and the negative intensity, and possible variation during the method of various parameters: form factor, value of the potential, frequency, value of the current, UA/IC ratio.

With such a method, at the interface between the surface to be treated and the liquid, then appear micro-arcs which generate a complex and very hard layer of oxide ($Al_20_3$ for an aluminum base alloy, $TiO_2$ for a titanium base alloy and MgO for a magnesium base alloy). It is possible to also achieve thick coating layers ranging up to 200 μm.

The ceramic coating has great resistance to wear and tear, good protection against corrosion and good electrical insulation. Its hardness is greater than 1100 HV. In order to carry out good protection of the alloy, a thickness will be selected greater than 40 μm, preferably between 60 μm and 80 μm.

The orbiting scroll 5 can furthermore have, on the surfaces in contact with the Oldham seal 9, a treatment masking or a ceramic coating or another surface treatment by anodic oxidation.

The compression device 1 can, furthermore, comprise a scroll seal 21 for the fixed scroll 3 and a scroll seal 23 for the orbiting scroll 5. The scroll seals 21, 23 have for function to provide the axial seal between the scrolls 3, 5 in order to guarantee that the pockets of gas are not unloaded before reaching the desired discharge pressure.

The scroll seal 21 is, more preferably, in the shape of a scroll in order to be positioned between an end of the wall 14 of the fixed scroll 3 and the inner surface 15 of the orbiting scroll 5. Similarly, the scroll seal 23 is, more preferably, in the shape of a scroll in order to be positioned between an end of the wall 18 of the orbiting scroll 5 and the inner surface 11 of the fixed scroll 3.

The compression device 1 can also include a scroll prop 25. The prop has, more preferably, a scroll shape that corresponds to the shape of the orbiting scroll 5 in such a way that the scroll prop 25 can be inserted through the portion protruding from the orbiting scroll 5.

In this embodiment, the scroll prop 25 is glued on the inner surface 15 of the orbiting scroll 5 by means of a high-temperature structural adhesive. The collage of the prop is made possible by the integration of counterbores on the inner surface 15 of the orbiting scroll 5.

Figure 4:
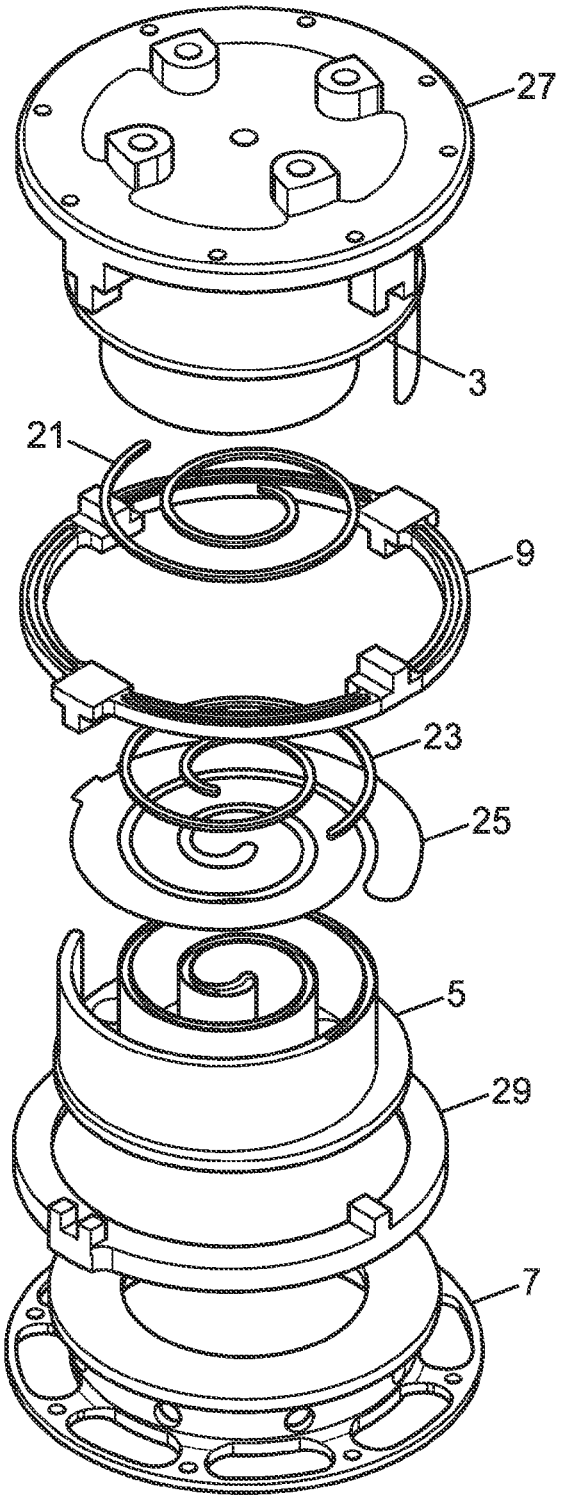
FIG. 4 is an exploded view in perspective of a compression device of a second embodiment.
Figure 5:
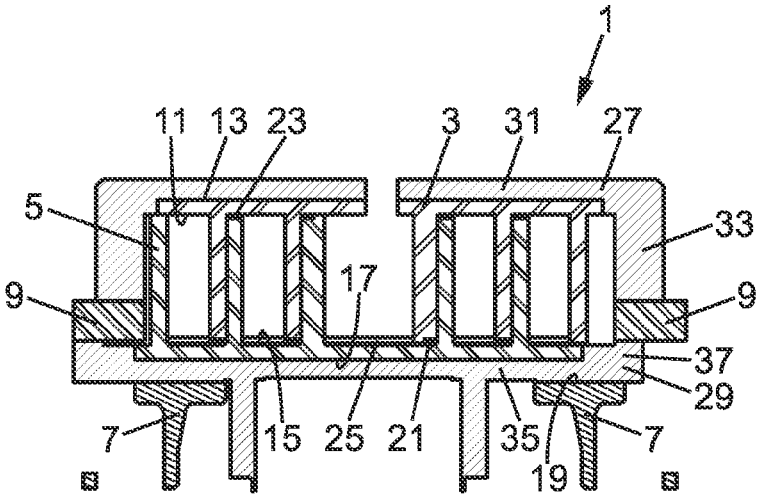
FIG. 5 is a longitudinal cross-section view of the compression device of FIG. 4.

FIGS. 4 and 5 show another embodiment of a compression device. FIG. 4 shows in an exploded view the general structure of this second embodiment. For this second embodiment, the references used in the FIGS. 1 to 3 are used to describe similar parts.

In this embodiment, a compression device 1 further comprises a first support 27 and a second support 29 and globally has the same characteristics as in the embodiment described relation with FIGS. 1 to 3.

The first support 27 is here positioned between the fixed scroll 3 and the Oldham seal 9. It can have, on the one hand, a disc 31 fixed on the outer surface 13 of the fixed scroll 3 and, on the other hand, a peripheral skirt 33 that cooperates with the Oldham seal 9 in order to provide the anti-rotation function and also maintain the Oldham seal 9 in contact with the orbiting scroll 5, more precisely here with the second support 29.

Similarly, the second support 29 receives the orbiting scroll 5. It can have on the one hand, a disc 35 fixed on the outer surface 17 of the orbiting scroll 5 and, on the other hand, a peripheral edge 37 cooperating with the Oldham seal 9. The second support 29 is as such coupled with the Oldham seal 9 in such a way as to provide a connection between these two parts. In addition, the second support 29 can be positioned between the orbiting scroll 5 and the flat thrust bearing 7 in such a way as to be in contact with the upper surface 19 of the flat thrust bearing 7.

The first support 27 and the second support 29 are preferentially formed of a grade of cast iron.

In an alternative of the embodiment of FIGS. 4 and 5, the disc 31 and the peripheral skirt 33 can be two parts independent from one another. Also, the peripheral skirt 33 can be divided into several connection parts between the fixed scroll 3 and the Oldham seal 9. Similarly, the disc 35 and the peripheral edge 37 can be two parts independent from one another. Also, the peripheral edge 37 can be divided into several connection parts between the orbiting scroll 5 and the Oldham seal 9 and between the orbiting scroll 5 and the flat thrust bearing 7.

A device according to one of the embodiments described hereinabove as such makes it possible to effectively compress a gas. It makes it possible to obtain a better compromise between the mass of the compression device and its reliability in relation to that of compression devices of prior art tout while still having a good service life.

As such, such a compression device is light, reliable, easy to mount and has, furthermore, a good service life. In addition, such a device does not require any lubrication, therefore its cost of maintenance is decreased.

These compression devices can have applications for example in devices that implement an air conditioning that incorporates a scroll compressor.

The mass/reliability compromise reached here is in particular very interesting for applications of aeronautical air conditioning on board helicopters and business aircraft.

This invention makes it possible to obtain devices of reduced mass since it makes it possible to carry out in light alloy (aluminum or other) the scrolls and the flat thrust bearing of the compression device.

At the starting of a compression device proposed here, the system can avoid any specific lubrication and it is not necessary to provide a supply of lubricant on the thrust bearing.

The coating obtained by micro-arc oxidation makes it possible, with parts made of a light alloy, to operate with a lubrication of the elasto-hydrodynamic type. This is not possible with parts made of a light alloy coated with a thin layer of coating because then the surface of the part is deformed substantially and a jamming of the parts in contact appears. Furthermore, when it wears, the particles that are detached from the coating are very fine and therefore do not affect the lubrication. The service life of the lubricant is therefore increased with respect to the use of coatings known in prior art.

Of course, this invention is not limited to the preferred embodiment and to the alternative embodiments presented hereinabove as non-limiting examples. It also relates to the alternative embodiments within the scope of those skilled in the art within the framework of the claims hereinafter.

What is claimed is:

1. Compression device comprising at least:

two interleaved scrolls (3, 5) each formed from an alloy with a density less than 5000 kg/m$^3$, the two interleaved scrolls including a fixed scroll (3), which is fixed, and an orbiting scroll (5), which moves eccentrically without rotating, anti-rotation means made of the alloy and configured to allow anti-rotation of said orbiting scroll (5), and a flat thrust bearing (7) configured to axially retain the orbiting scroll (5), wherein a surface of the orbiting scroll (5) configured to come into contact with the flat thrust bearing is covered with a first thick coating, with a thickness between 40 and 200 μm, with a hardness greater than 1100 HV and mostly comprised of an oxide derived from the alloy.

2. The compression device according to claim 1, wherein the two interleaved scrolls are made of a material selected from a group consisting of: aluminum, magnesium, and titanium alloys.

3. The compression device according to claim 1 wherein the flat thrust bearing is made of a material selected from a group consisting of: aluminum, magnesium, and titanium alloys, and a surface of the flat thrust bearing configured to contact the orbiting scroll is covered with a second thick coating, with a thickness between 40 and 200 μm, with a hardness greater than 1100 HV and comprised mostly of the oxide derived from the alloy.

4. The compression device according to claim 3, wherein at least one of the first thick coating or the second thick coating has a thickness between 60 and 80 μm.

5. The compression device according to claim 3, wherein at least one of the first thick coating or the second thick coating is an oxidation layer of the alloy obtained by a micro-arc oxidation method.

6. The compression device according to claim 1, wherein the flat thrust bearing and the orbiting scroll are made from an aluminum alloy that resists high temperatures up to 150° C.

7. The compression device according to claim 1, further comprising at least one scroll prop (25) glued to one of the two interleaved scrolls (3, 5) by a structural adhesive that resists temperatures up to 180° C.

8. The compression device according to claim 1, wherein the fixed scroll (3) has a hard anodization treatment impregnated with Polytetrafluorethylene (PTFE) at least on one surface facing the orbiting scroll (5).

9. The compression device according to claim 1, wherein the anti-rotation means have a hard anodization treatment impregnated with PTFE at least on one surface facing the fixed scroll (3) and/or on at least one surface facing the orbiting scroll (5).

10. The compression device according to claim 1, further comprising at least one first support (27) formed from a grade of cast iron and suitable for interfacing with the fixed scroll (3) by providing a connection between said fixed scroll (3) and the anti-rotation means.

11. The compression device according to claim 1, further comprising at least one second support (29) formed of from a grade of cast iron and suitable for interfacing with the orbiting scroll (5) by providing a connection on the one hand between said orbiting scroll (5) and the anti-rotation means, and on the other hand entre said orbiting scroll (5) and the flat thrust bearing (7).

12. Scroll compressor, comprising at least one compression device (1) according to claim 1.

13. The compression device according to claim 1, wherein the first thick coating is formed as a single layer of the oxide derived from the alloy.

* * * * *